US005311683A

United States Patent [19]

Camilleri

[11] Patent Number: 5,311,683

[45] Date of Patent: May 17, 1994

[54] PROPULSION APPARATUS

[75] Inventor: Paul Camilleri, Queensland, Australia

[73] Assignee: Foundation Technology Limited, Australia

[21] Appl. No.: 729,920

[22] Filed: Jul. 15, 1991

Related U.S. Application Data

[63] Continuation of Ser. No. 338,010, Apr. 14, 1989, abandoned, which is a continuation-in-part of Ser. No. 59,745, Jun. 8, 1987, Pat. No. 4,843,742.

[30] Foreign Application Priority Data

Jun. 13, 1986 [AU] Australia ..... PH 6409
Jan. 27, 1989 [AU] Australia ..... PJ 2467

[51] Int. Cl.[5] ..... E02F 3/14; E02F 5/08; E02D 5/18

[52] U.S. Cl. ..... 37/90; 37/86; 37/192 A; 37/195; 37/357; 37/355; 405/267

[58] Field of Search ..... 37/83, 86, 89, 87, 90, 37/91, 191 R, 195, 191 A, 192 A; 405/258, 267, 303; 299/41, 55, 56

[56] References Cited

U.S. PATENT DOCUMENTS

| | | | |
|---|---|---|---|
| 1,306,350 | 6/1919 | McIntire | 37/86 |
| 1,769,074 | 7/1930 | Ruatti | 37/86 |
| 1,850,363 | 3/1932 | Vaughn | 37/86 |
| 3,951,459 | 4/1976 | Honeycutt, Jr. | 37/87 X |
| 4,681,483 | 7/1987 | Camilleri | 405/258 X |
| 4,843,742 | 7/1989 | Camilleri | 37/90 |
| 4,861,199 | 8/1989 | Hackmack | 405/267 |
| 4,930,940 | 6/1990 | Charlier et al. | 405/303 X |

*Primary Examiner*—Randolph A. Reese
*Assistant Examiner*—J. Russell McBee
*Attorney, Agent, or Firm*—Wood, Herron & Evans

[57] ABSTRACT

Propulsion apparatus is disclosed for urging a trenching arm forward against the advancing face of an elongate trench being dug by the trenching arm. The propulsion apparatus includes a propulsion member which is engageable with the base wall of the trench such that the trenching arm may be urged forward relative to the engaged propulsion member. The propulsion member may then be withdrawn from engagement with the base wall and retracted towards the trenching arm before commencing a further propulsion cycle. The propulsion member is also operable to cooperate with the trenching arm in excavating a starting slot at the beginning of a new trench.

7 Claims, 14 Drawing Sheets

PROPULSION APPARATUS

This application is a continuation of Ser. No. 07/338,010, filed Apr. 14, 1989 and now abandoned, which is a continuation-in-part of Ser. No. 07/059,745, filed Jun. 8, 1987 and now U.S. Pat. No. 4,843,742.

BACKGROUND OF THE INVENTION

This invention relates to a trenching or trench excavating apparatus wherein a deep trench is dug and corners are formed, the trench to receive poured concrete as in the formation of an inground retaining wall. It is contemplated that the trench dug by the apparatus will have a depth of up to or exceeding 25 feet.

Propulsion apparatus which is engageable with the side or base walls of a trench is disclosed in co-pending application Ser. No. 059,745, and may be utilized to provide propulsive force within the trench, enabling a relatively light machine to be used for a particular trenching operation. Such propulsion apparatus may have difficulty adapting to varying ground types and may jam due to the ingress of dirt dislodged during the excavation process, or wet concrete, which is often poured immediately behind the trenching arm to minimize the probability of trench collapse in soft ground conditions.

DESCRIPTION OF THE PRIOR ART

The prior art discloses endless chain excavators together with mobile concrete forms mounted behind the excavator. It is intended that the excavator continuously dig a trench and while the trench is being dug, concrete is poured behind the excavator into the form carried by the excavator. The upper end of the excavator is mounted on a tractor that moves along the ground carrying the excavator with it.

In digging trenches and pouring concrete for retaining walls, it is important for the excavator to maintain a vertical attitude and for the assembly to dig itself into the ground to the proper depth in a vertical attitude. In this way proper corners can be formed.

When excavating a trench that is of considerable depth, for example 25 feet deep, it is extremely difficult to move the lower end of the excavator at the same pace as the tractor which carries the upper end. Hence, it is difficult, if not impossible, to maintain the required vertical attitude of the excavator without adding costly and heavy bracing structure between the tractor and excavator.

U.S. Pat. No. 4,681,483 discloses a foot which may be utilized for excavating material when excavating an initial slot from which a trench may be formed. There is no provision, however, in that patent for utilizing the foot for effective propulsion of the trencher. As described in that patent, that foot is employed for digging only.

SUMMARY OF THE PRESENT INVENTION

It is an object of the present invention to alleviate the above and other disadvantages and to provide improved trenching apparatus and methods of forming inground retaining walls which will be reliable and efficient in operation. Another object of the present invention is to provide for the propulsion of a vertically-oriented excavator at the lower end of the excavator.

A further object of the present invention is to combine a digger with the propulsion system so as to enable the excavator and accompanying structure, such as a concrete form, to dig itself into the ground in a substantially vertical attitude. Other objects and advantages of this invention will hereinafter become apparent.

The objects of the invention are attained, in part, by mounting a combined digger and propulsion element at the lower end of the excavator. A drive system for the combined element is provided to impart digging motion to the element during the digging operation (i.e., "digging" constitutes the action of the digger in digging the trenching arm into the ground) and to provide propulsive motion to the element during the excavating operation (i.e., the "excavating operation" constitutes excavation of the trench itself which occurs after the digging operation by forward movement of the trenching arm against the advancing face of the trench).

A mechanism is provided for thrusting that combined element downwardly into the ground to support a portion of the weight of the excavator and to obtain a good grip upon the base wall of the trench.

In a preferred form of the invention, a foot of the type shown in U.S. Pat. No.4,681,483 is mounted at the end of the excavator. In accordance with one aspect of the present invention, a linkage and a propulsion ram have been added to impart a propulsion motion to the foot. Still further, a vertical loading ram has been provided to lift the foot as it steps forward and to press the foot down so that it takes part of the weight of the excavator.

The advantages of the present invention are that it becomes possible to dig straight down with the excavator and accessory equipment, such as a concrete form, and when the desired depth has been obtained to proceed forward, digging a trench, with the excavator maintained in a vertical attitude. At a corner, the excavator is raised, shifted to the proper angle to form the corner and driven straight down to begin the excavation of the adjacent wall.

In the preferred embodiment, one element becomes a digger, a propulsion element, and a loading device to accept part of the weight of the excavator in order to obtain the necessary grip on the trench so that a forward force can be imparted to the lower end of the excavator.

In one aspect, this invention resides broadly in a trenching arm propulsion apparatus for urging a trenching arm forward to engage with the advancing excavation face of a trench, said propulsion apparatus including:

a propulsion member engageable with the base wall of the trench;

preload apparatus adapted for urging said propulsion member against the base wall;

drive apparatus for driving the trenching arm forward along the trench relative to said propulsion member from a starting position adjacent said propulsion member;

retraction apparatus for withdrawing said propulsion member into a stowed position free of operative contact with the base wall; and reverse drive apparatus for drawing said propulsion member forward to said starting position.

The propulsion member may include a flat or curved plate engageable frictionally with the base wall, or there may be provided propulsion plate inclination means whereby the propulsion plate may be moved between an engagement-drive attitude substantially normal to the base wall and a frictional-drive attitude substantially parallel to the base wall.

The preload apparatus may include an actuator of any type such as a rotary or linear electric actuator. It is preferred, however, that the preload apparatus include a linear hydraulic preload actuator, and that the preload actuator be of a reversible type, such that it may also operate the retraction apparatus, although the latter may be operated by an independent hydraulic retraction actuator if desired. The propulsion apparatus may be attached to the trenching arm by slides along which the propulsion member may be driven by the preload actuator. The latter may be controlled to provide any desired preload function, but it is preferred that the preload actuator be controlled to maintain a substantially constant level of preload during operative movement of the propulsion member such that a substantially constant tractive effort may be obtainable therefrom.

Preferably, the drive apparatus includes a double-acting propulsion actuator such that it may also function as the reverse drive apparatus, although separate actuators may be used if desired. A positioning actuator may also be provided and may be adapted to interact with the propulsion actuator such that the displacement of the propulsion member relative to the trenching arm along and normal to the wall may be controlled to any desired configuration by actuator control means. For instance, the actuator control means may control the propulsion and positioning actuators to hold the propulsion member at a desired attitude relative to the wall while it is extended relative to the trenching arm, and may then control the preload actuator to withdraw the propulsion member from the wall before returning it to a position adjacent the trenching arm.

The drive apparatus and the reverse drive apparatus may include separate actuators, but it is preferred for simplicity that a double-acting propulsion actuator be provided for operating both the drive apparatus and the reverse drive apparatus. The propulsion apparatus may further include a positioning actuator adapted to interact with the propulsion actuator such that the displacement of the propulsion member relative to the trenching arm along and normal to the wall may be controlled to a desired configuration by actuator control means.

The actuator control means may control the propulsion and positioning actuators to hold the propulsion member at a desired attitude relative to the base wall while it is extended relative to the trenching arm, and may control the preload actuator to withdraw the propulsion member from the base wall before returning it to a position adjacent the trenching arm. The actuator control means may be set to control the preload, propulsion and positioning actuators for operation of the propulsion member in an excavating mode for cooperating with the trenching arm to excavate a starting slot for a trench, and in a propulsion mode for urging the trenching arm forward within a trench. Actuator travel sensing means may be provided for feedback of propulsion member position and attitudo, whereby the control means may be provided with feedback signals.

The propulsion apparatus may be fitted to a stand alone trenching arm adapted for excavating a trench while being supported and propelled by the propulsion apparatus and/or an upper drive apparatus. In a preferred embodiment, however, the trenching arm is supported at its upper end on a tractor which provides the drive for urging its upper end forward, as well as supporting chain drive apparatus for driving the trenching chain.

In a further aspect, this invention resides in continuously-operable propulsion apparatus for a trenching arm including:

a propulsion element frame;

a continuous propulsion element movable about said propulsion element frame and having an endless propulsion surface engageable between said propulsion element frame and the base wall of a trench;

preload apparatus connected between the trenching arm and said propulsion support frame for urging said propulsion element into engagement with the base wall; and drive apparatus for moving said continuous propulsion element about said propulsion element frame.

The continuously-operable propulsion means may be divided transversely into a plurality of propulsion segments between which support means for the propulsion element frame may pass. The propulsion segments may be provided with extendible cutter apparatus moveable between an extended position in which material may be cut from outside or between the propulsion segments and a stowed position in which the cutter apparatus is confined within the axial boundaries of the propulsion segments such that material may be excavated adjacent the support means.

The drive means may be formed to drive the propulsion means in a reverse drive mode to function as a supplementary excavation device for cooperating with the trenching arm to excavate a starting slot from which the trench may be cut. The propulsion means may include a rotary wheel or an endless belt. The endless belt may be segmented transversely into belt segments whose travel paths away from the base wall diverge to form a transverse aperture through which support means for said propulsion element frame may pass.

In another aspect of this invention, chain apparatus for application in the presence of dirt or mud is disclosed, said chain apparatus including a plurality of chain links pivoted together along transverse pivot axes, each said chain link including a front link face and a rear link face adapted for operative sealing engagement with respective rear and front link faces on adjacent ones of said links over a range of angles of articulation between adjacent ones of said links about said pivot axes such that operative sealing is maintained between adjacent links during passage of the chain apparatus about a sprocket.

Suitably, the front and rear link faces are formed of part-cylindrical portions having their cylinder axes substantially coincident with respective pivot axes, whereby they may pivot cooperatively such that operative sealing is maintained therebetween.

In yet another aspect, this invention resides in a method of propelling a trenching arm forward within a trench to engage with the advancing excavation face of the trench, including:

providing a propulsion apparatus having a propulsion element engageable with the base wall of the trench and operable to move the trenching arm forward relative to the base wall; and operating said propulsion apparatus to urge the trenching arm against the advancing excavation face of the trench.

In yet another aspect, this invention resides in excavation apparatus including:

a tractor;

a vertical endless chain excavator mounted on said tractor;

a form for concrete extending vertically behind said excavator;

an elongated foot mounted at the lower end of said form;

foot rotation means for swinging said foot back and forth in a vertical attitude for digging vertically;

foot displacement means for moving said foot back and forth in a horizontal attitude to propel the lower end of said excavator forward; and preloading means for applying at least a portion of the weight of said excavator onto said foot.

In one further aspect of this invention, excavation apparatus is disclosed including:

a tractor;

a vertical endless chain excavator mounted on said tractor;

a form for concrete extending vertically behind said excavator; and a combined vertical digger and forward propulsion unit mounted on the lower end of said form.

The combined vertical digger and forward propulsion unit may include an endless element carrying teeth and drive means for driving the endless element in one direction to dig and in an opposite direction for propulsion.

In one more aspect, this invention resides in excavating apparatus including:

a tractor operable at ground level;

an endless bucket excavator projecting in excess of 20 feet below ground level; and a propulsion mechanism mounted on the lower portion of said excavator to move the lower end of said excavator against an unexcavated face of a trench as the upper end of the excavator is advanced by said tractor.

BRIEF DESCRIPTION OF THE DRAWINGS

In order that this invention may be more readily understood and put into practical effect, reference will now be made to the accompanying drawings, wherein.

DETAILED DESCRIPTION OF THE PREFERRED EMBODIMENTS

Figure 1:
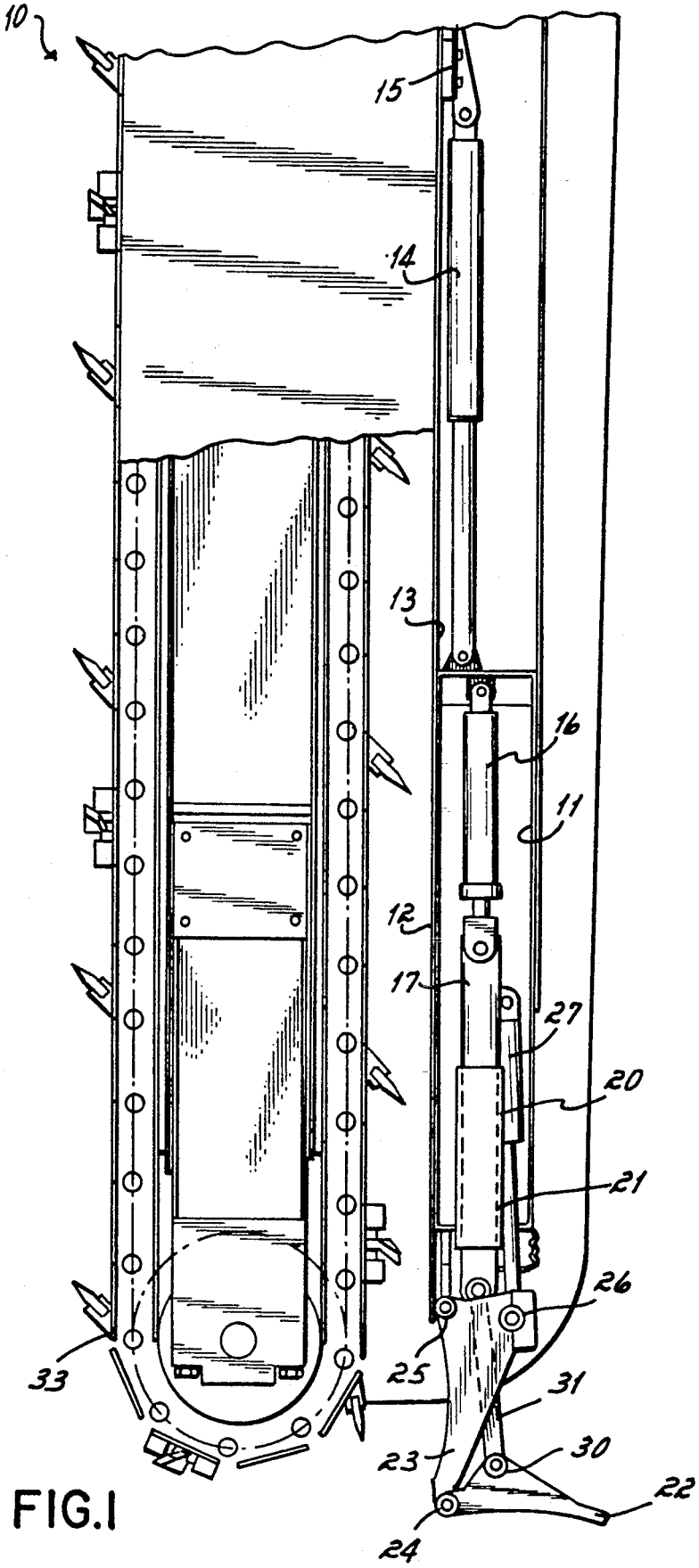
FIG. 1 is a sectional side view of a propulsion apparatus according to the invention.

The propulsion apparatus 10 shown in FIGS. 1 to 9 is enclosed in a housing 11 slidably attached to the rear face of a trenching arm 12 along slides 13. The housing 11 is moveable along the trenching arm 12 by a preloading actuator 14 attached to the trenching arm 13 by a pair of interlocking racks 15 which may be adjusted to obtain the desired range of movement for the housing 11 relative to the base of the trenching arm 12.

Within the housing 11 is a hydraulic positioning actuator 16, the operating rod 17 of which extends through a slide 20 and rod seals 21 attached to the base of the housing 11. The propulsion foot 22 is pivoted to the base of a foot carrier 23 by a foot pivot 24, and the foot carrier 23 in turn has an upper front pivot 25 connected direct to the housing 11 and an upper rear pivot 26, which is connected to the housing 11 through a propulsion actuator 27. A crank arm 30 formed on the rear of the propulsion foot 22 is connected to the operating rod 17 through a link 31. A flexible boot 28 surrounds the lower end of the propulsion actuator 27 to prevent the ingress of dirt or wet concrete into the housing 11.

An endless digging chain 33 passes around the trenching arm 12 and may be utilised for excavating a slot beneath itself when excavating a vertical starting slot for a trench or for excavating a trench in front of itself when forming the trench.

Figure 2:
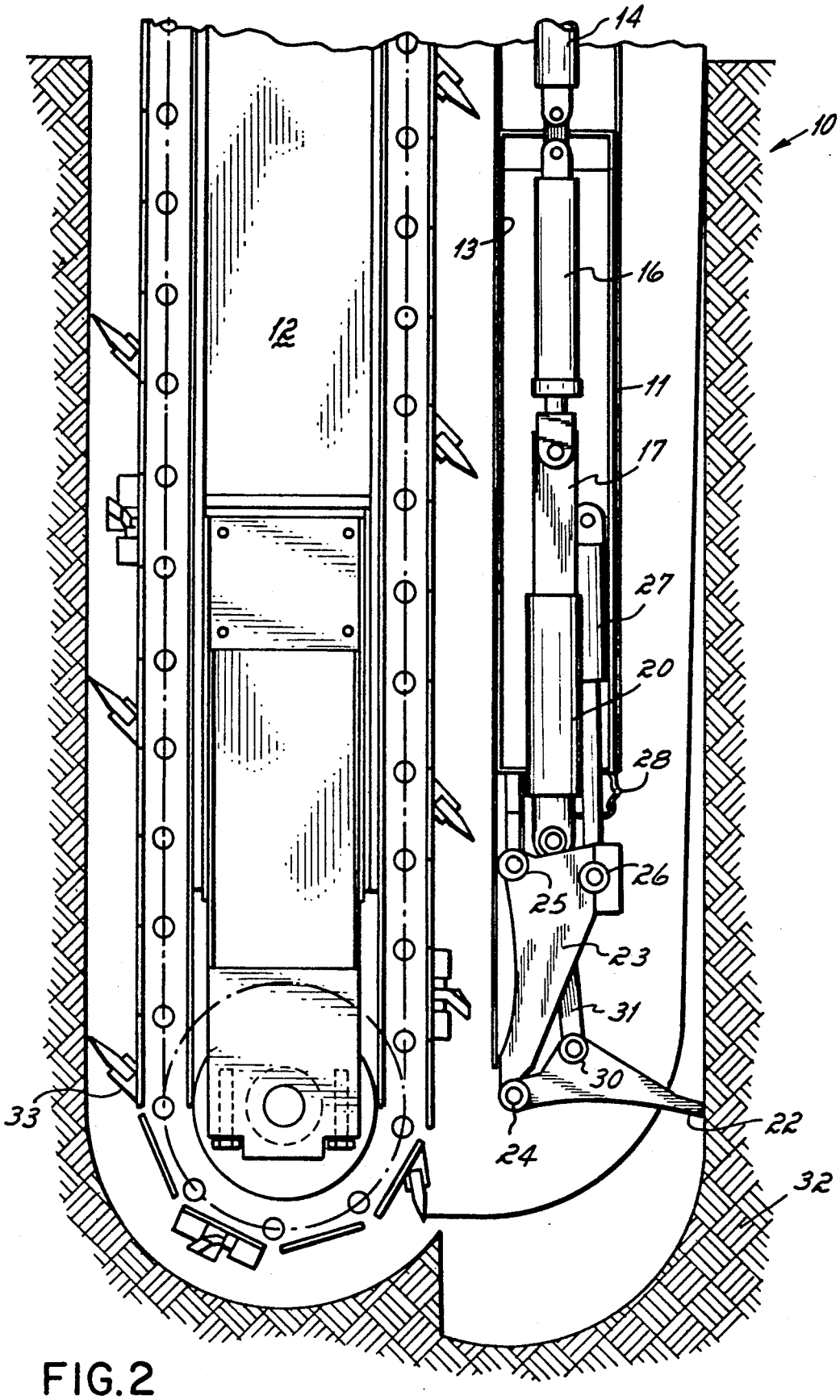
FIGS. 2, 3, 4 and 5 are partial side views of the propulsion apparatus of FIG. 1, showing the propulsion foot in the four extremes of its movement during a slot excavation cycle.
Figure 3:
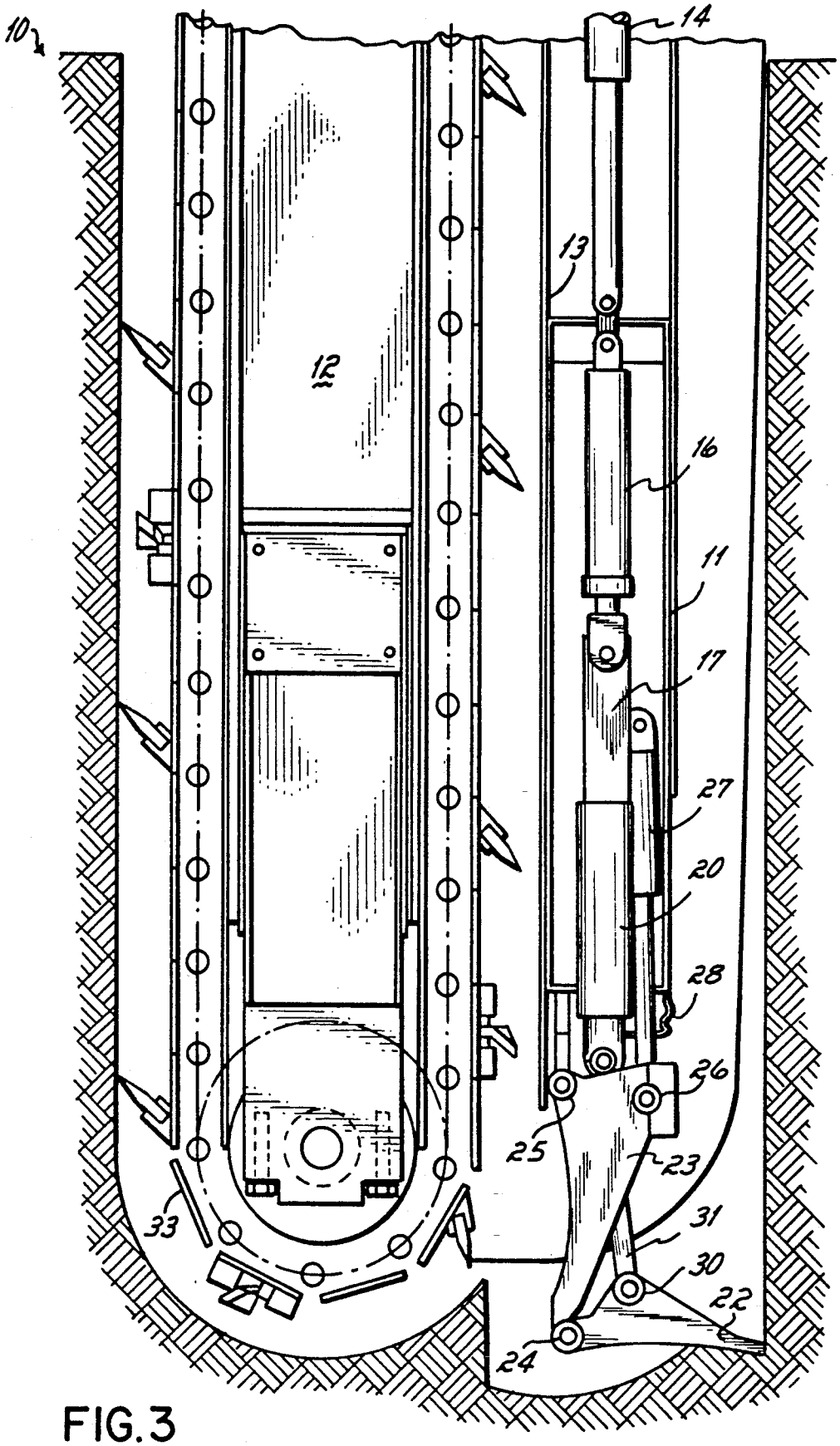
Figure 4:
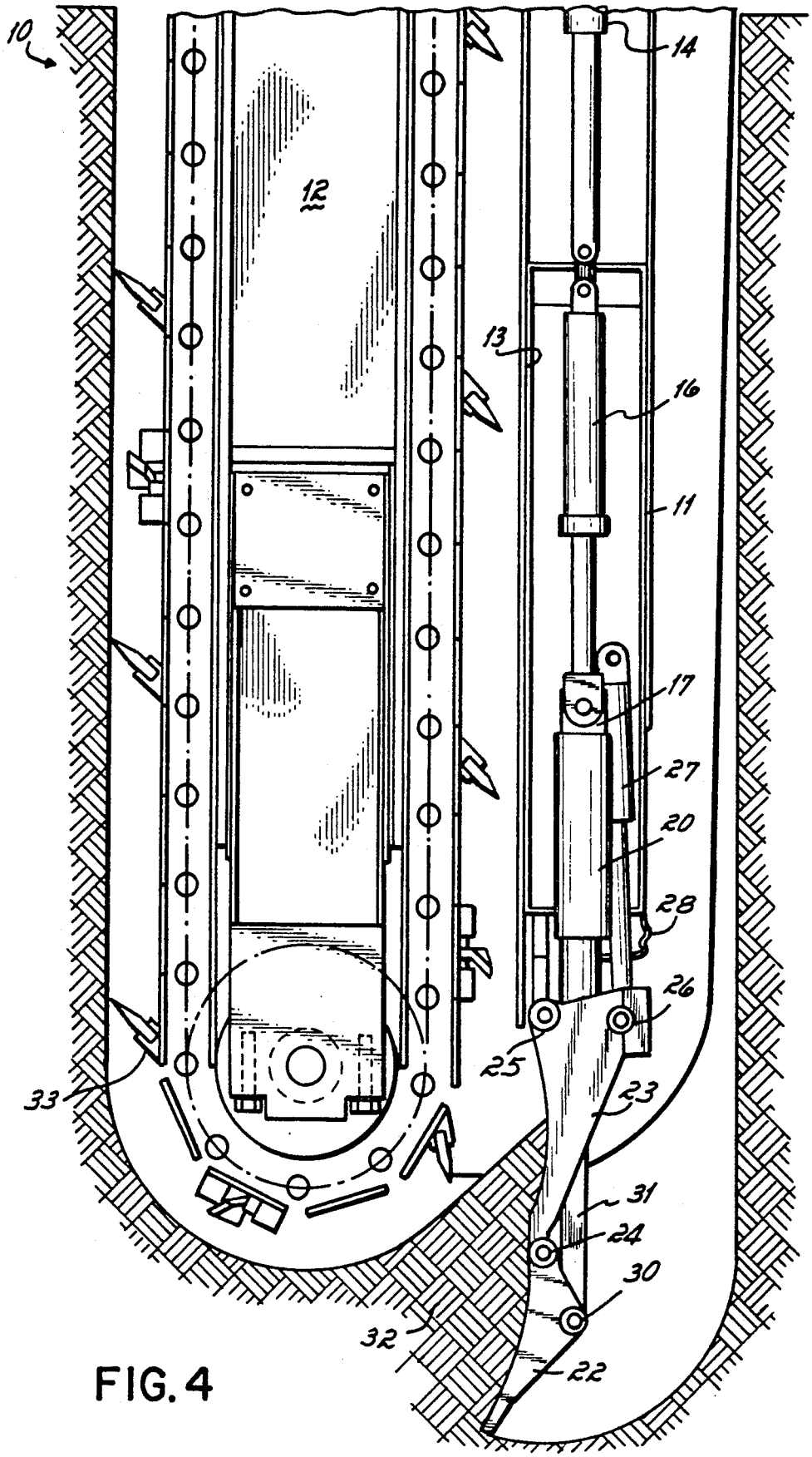
Figure 5:
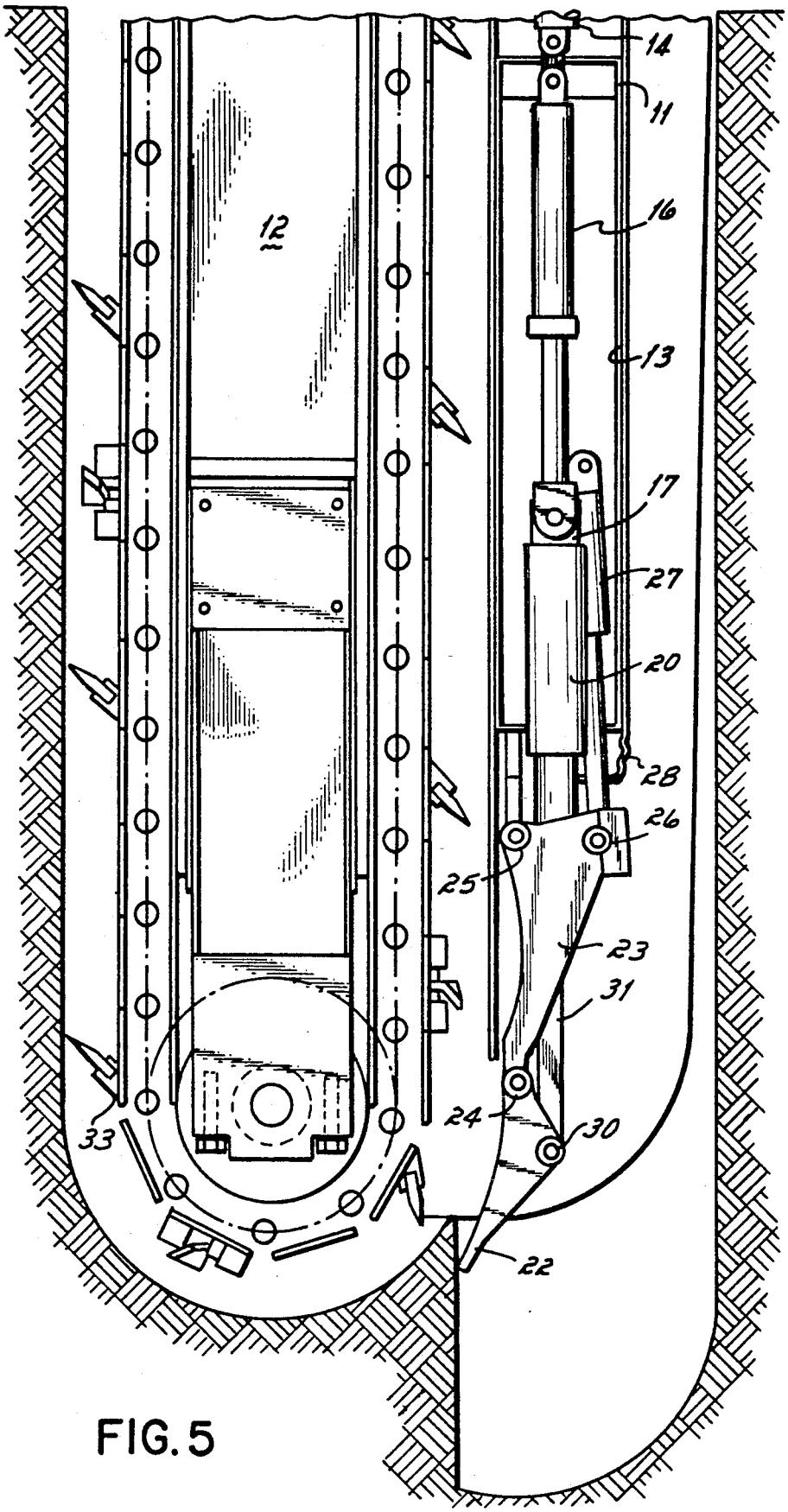

As shown in FIGS. 2 to 5, the trenching arm 12 is operable to excavate a vertical starting slot beneath itself to position itself for the excavation of a trench. During this phase of the trenching operation, the propulsion foot 22 is operated in a slot excavation cycle to scrape material 32 from beneath the propulsion apparatus 10 and deposit it adjacent the trenching arm 12 where it may be picked up by the trenching chain and drawn to the surface for disposal. Firstly, the foot 22 is moved into a raised horizontal position by retraction of the positioning actuator 16 and the preloading actuator 14, as shown in FIG. 2. The foot 22 is then forced downward into the material 32 by extension of the preloading actuator 14, as shown in FIG. 3. While engaged within the material 32, the foot 22 is then swung in an arc of approximately ninety degrees about the foot pivot 24, as shown in FIG. 4, shearing material 32 from beneath the propulsion apparatus 10 and depositing it adjacent the trenching arm 12, from where the digging chain 33 conveys it around the front of the trenching arm 12 to the surface of the ground. The preloading actuator 14 is then retracted to raise the foot 22 clear of the material 32, as shown in FIG. 5, after which the foot 22 is swung back into the horizontal position in which it began the cycle.

Figure 6:
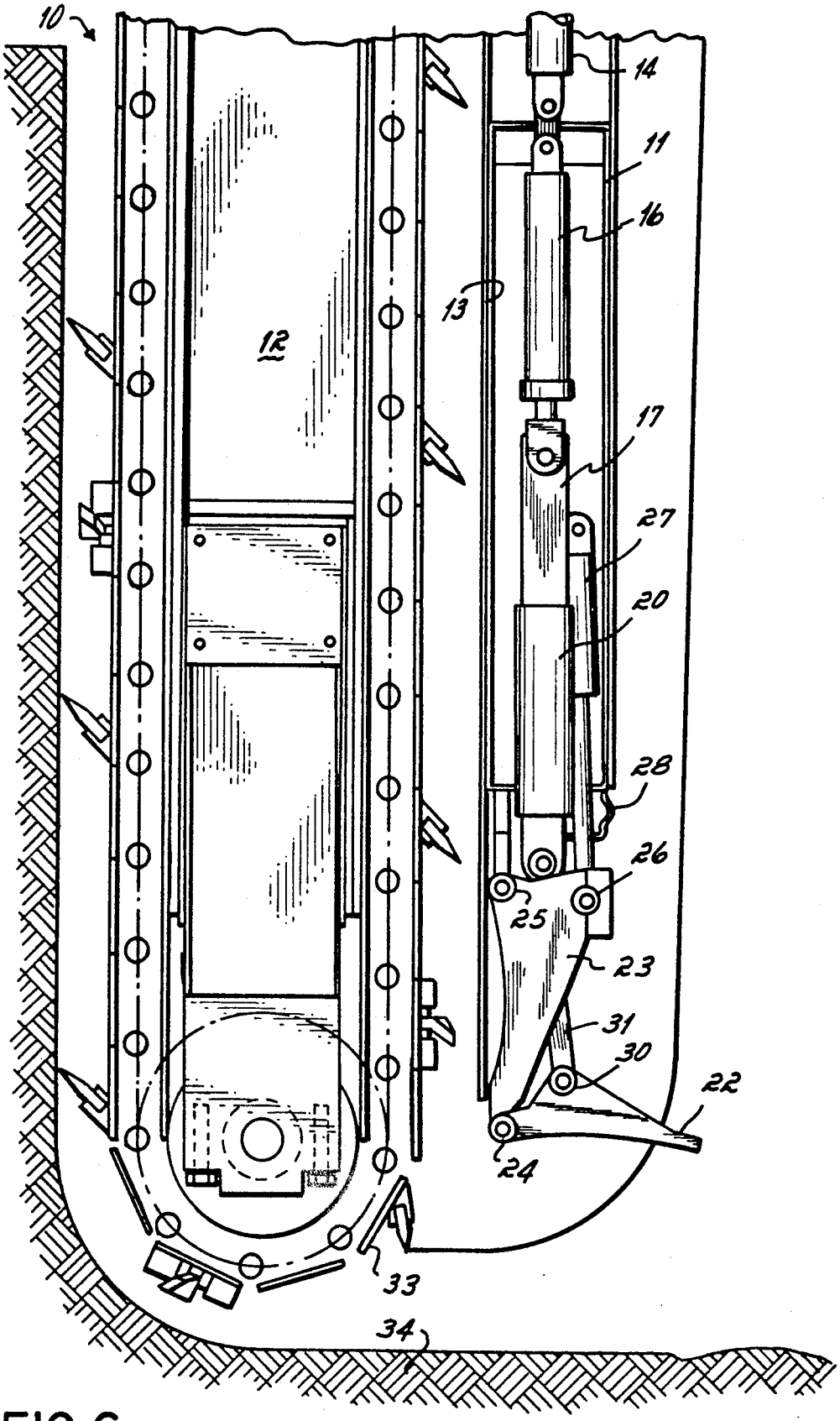
FIGS. 6, 7, 8 and 9 are partial side views of the propulsion apparatus of FIG. 1, showing the propulsion foot in the four extremes of its movement during an arm propulsion cycle.
Figure 7:
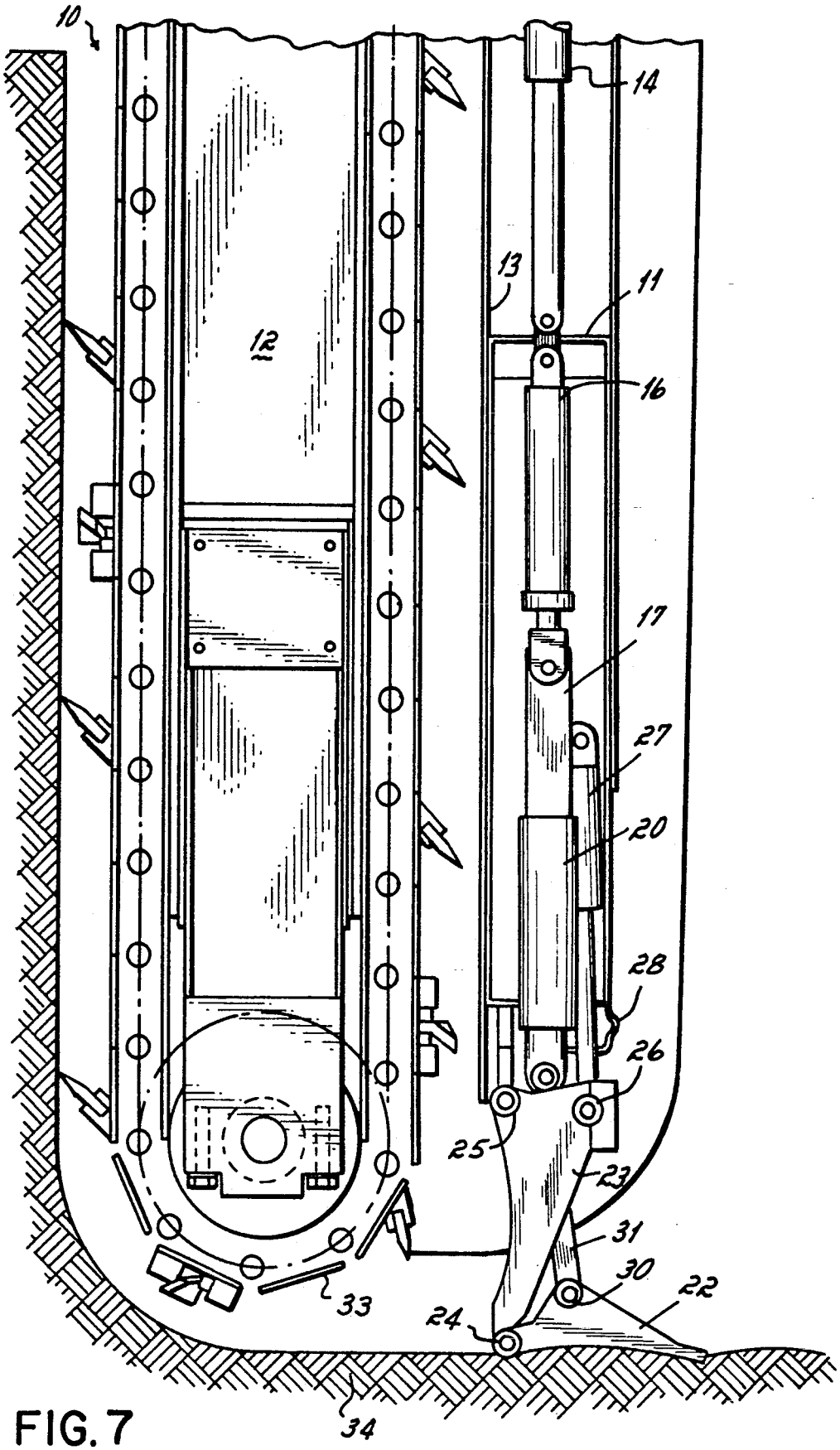
Figure 8:
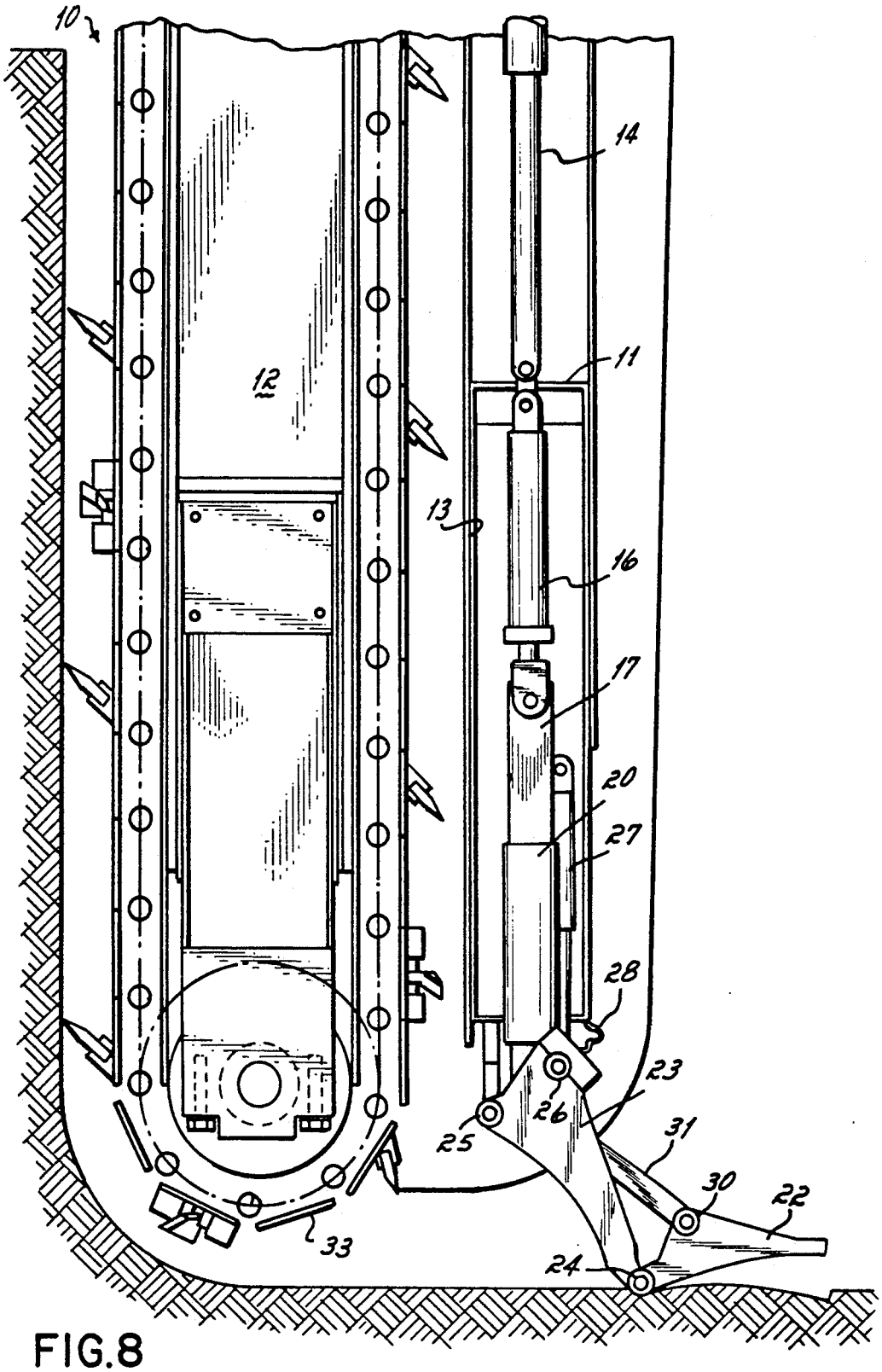
Figure 9:
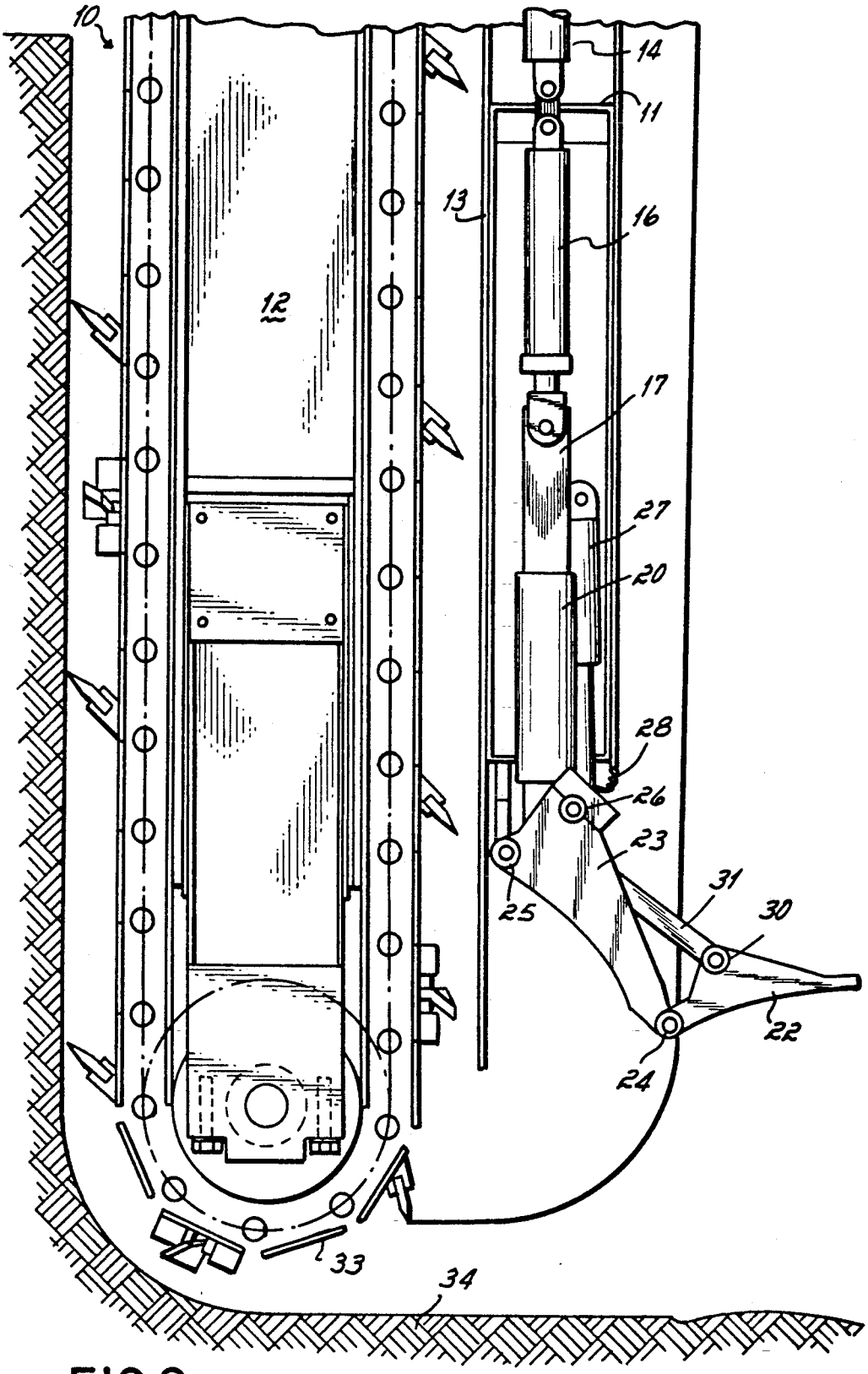

Referring now to FIGS. 6 to 9, it will be seen that, when the trenching arm 12 has reached the desired depth for the excavation, the propulsion foot 22 may be operated in a propulsion cycle to force the trenching arm 12 forward into the advancing face of the trench. At the beginning of a propulsion cycle, as shown in FIG. 6, the foot 22 is held in a raised horizontal position with the preloading actuator 14 and the positioning actuator 16 in their retracted positions. Referring now to FIG. 7, the preloading actuator is then extended until the foot 22 is engaged with the base wall 34 of the trench with the desired level of preload applied to it. This preload may be controlled to any desired value, but it is preferred that it attain a significant portion of the weight of the trenching arm 12 and the trenching machine supporting it, whereby significant longitudinal drive force may be generated by the propulsion apparatus 10. The propulsion actuator 27 is then retracted, rotating the foot carrier 23 about the upper front pivot 25 such that the foot 22 is forced rearward relative to the housing 11, as shown in FIG. 8, urging the trenching arm 12 forward. The foot carrier 23 and the link 31 form a linkage which maintains the foot 22 in a substantially horizontal attitude during this phase of the cycle. When the foot 22 has reached the limit of its rearward travel relative to the trenching arm 12, the preloading actuator 14 is retracted, as shown in FIG. 9, raising the foot 22 away from the base wall 34, after which extension of the propulsion actuator 27 drives the foot carrier 23 and the attached foot 22 forward into its starting position.

If the ground conditions are deemed to be unsuitable for force transfer by frictional contact between the foot 22 and the base wall 34, such as in the case of wet clay, the positioning actuator 16 may be extended sufficiently to rotate the foot 22 into a substantially vertical position such that it may embed itself into the base wall 34 to provide the necessary force transfer.

Figure 10:
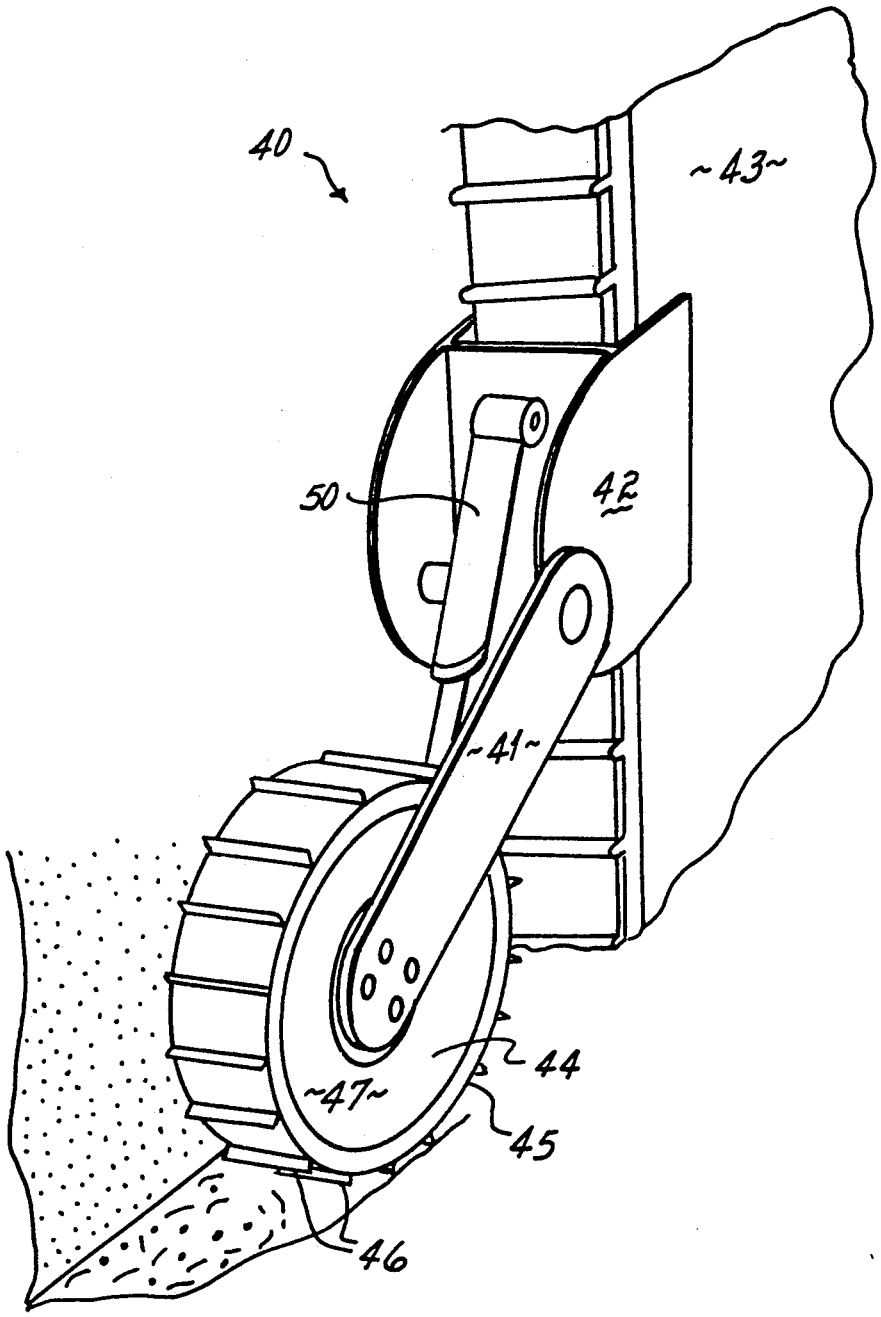
FIG. 10 is a pictorial view of a wheel-type propulsion apparatus according to the invention.

The wheel-type propulsion apparatus 40 shown in FIG. 10 has a support arm 41 pivoted to a support frame 42 attached to a trenching arm 43. A radial-piston hydraulic motor 44 of the rotating-casing type has its shaft bolted to the outer end of the support arm 41, and a wheel rim 45 with cleats 46 is attached around the motor casing 47. A preload actuator 50 extends between the support arm 41 and the support frame 42 to permit the wheel rim 45 to be forced against the base of the trench 51.

The propulsion apparatus 40 may be operated to propel the trenching arm 43 along the trench (unnumbered) by rotating the wheel rim 45 forward (i.e., clockwise as viewed in FIG. 10) at a slow rate comparable to the advance rate of the trenching arm 43. Where it is necessary to excavate a slot at the start of a trench 51, the wheel rim 45 may be rotated backwards (i.e., counterclockwise as viewed in FIG. 10) at higher speed such that the cleats 46 may scrape material from beneath the wheel rim 45 and deliver it to the trenching arm 43 for transport to the surface.

The chain-type propulsion apparatus 60 shown in FIGS. 11 to 14 has a housing 61 which is attached through slides 62 to a trenching arm 63. A chain assembly 64 is attached to the lower end of the housing 61 and comprises a chain frame 65 about which a central chain 66 and outer chains 67 pass. The central chain 66 passes over front sprocket assembly 70 and rear sprocket 71, while the outer chains 67 also pass over upper sprocket assembly 72. The chain frame 65 is connected to the housing 61 via a bifurcated support (unnumbered) which passes between the upper portions of the central and outer chains 66 and 67. Roller chains 74 and 75 provide drive from hydraulic motors 76 and 77 to the upper sprocket assembly 72. The roller chain 74 from the upper hydraulic motor 76 passes around idlers 80 to clear the lower hydraulic motor 77.

The chains 66 and 67 comprise links 81 formed with complementary front and rear faces 82 and 83 respectively which slide relative to one another as the links 81 pass around a sprocket such that no significant passages open up for the ingress of dirt or wet concrete. Face seals 85 attached to the chain frame 65 engage with recessed side faces 86 on the links 81 to minimize ingress of dirt or wet concrete through these gaps.

Figure 11:
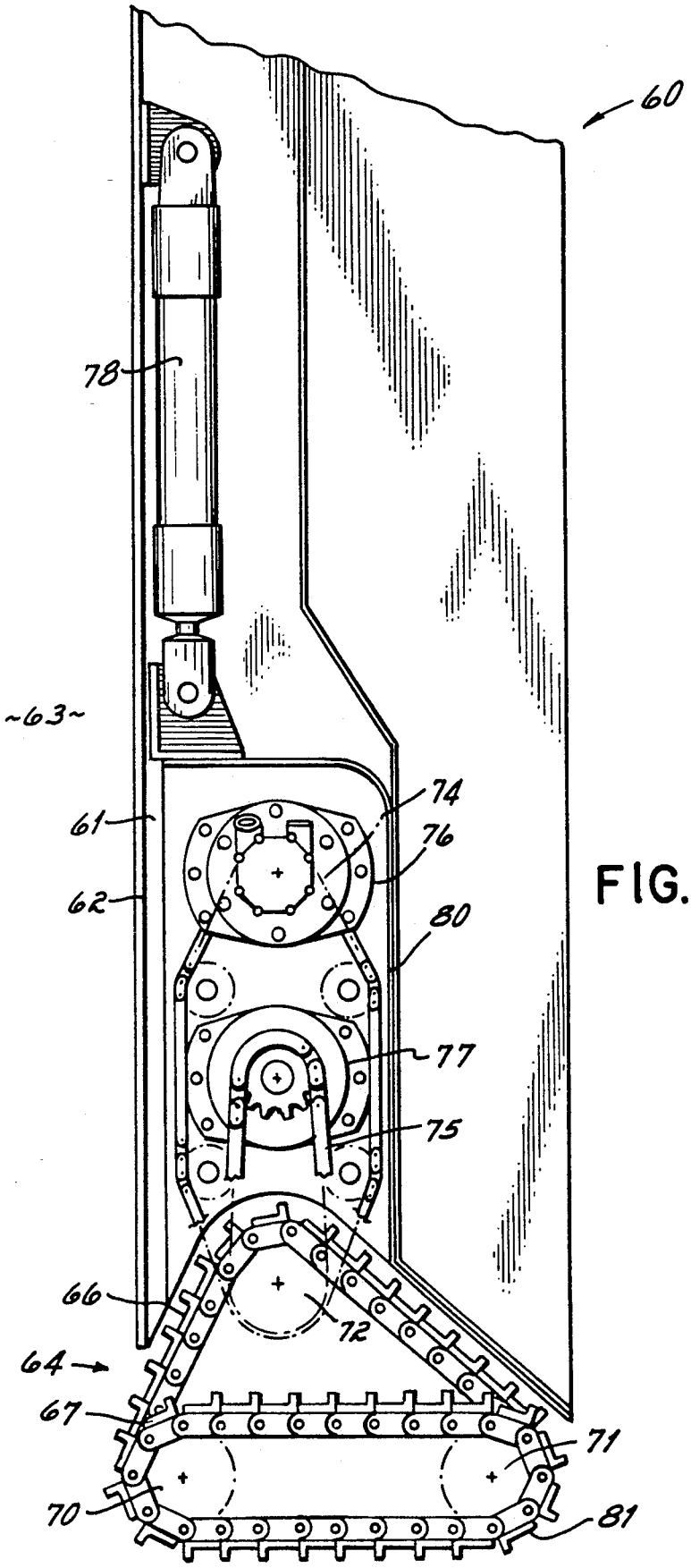
FIG. 11 is a sectional side view of a chain-type propulsion apparatus according to the invention.
Figure 12:
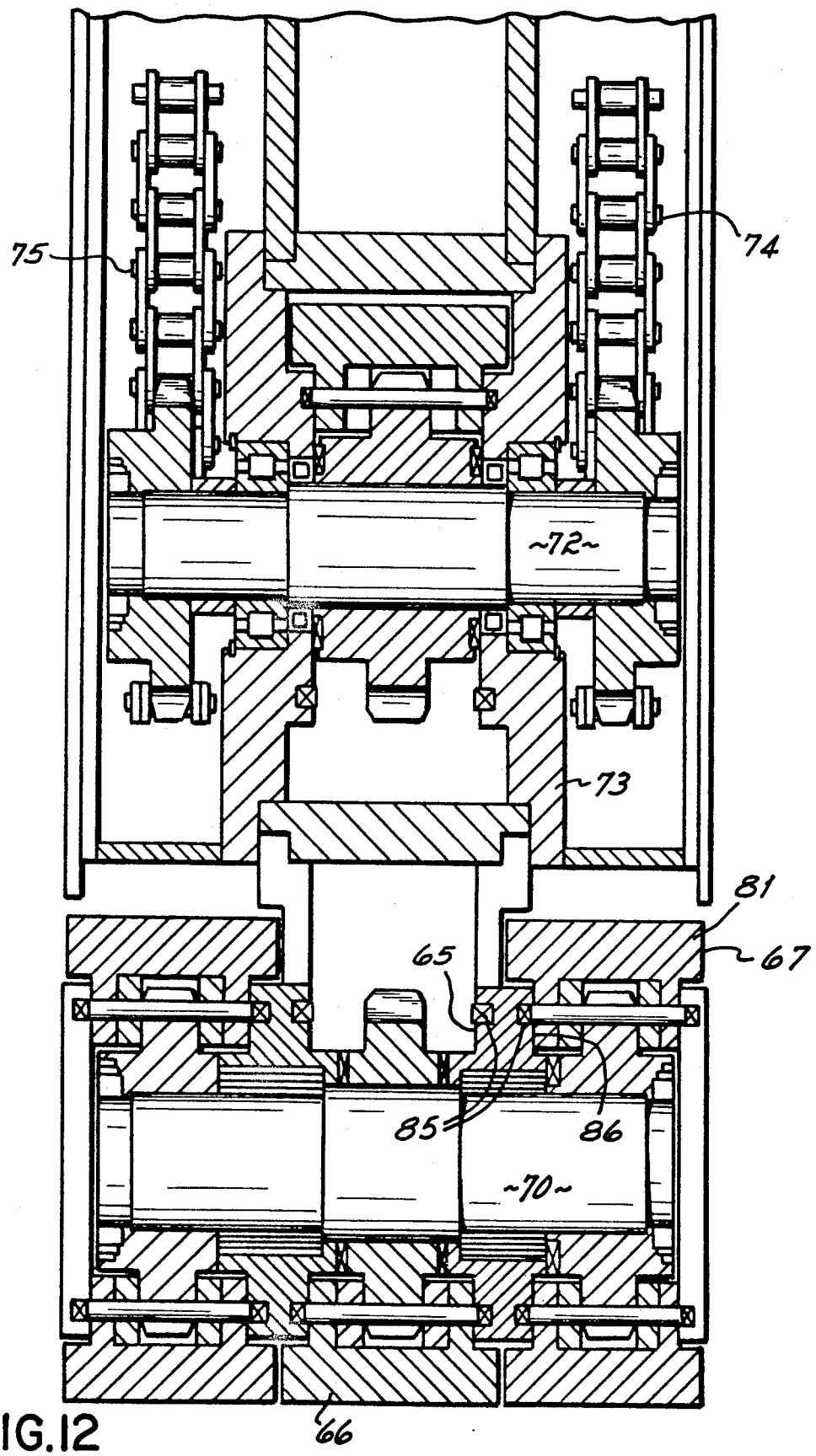
FIG. 12 is a sectional top view of the propulsion apparatus of FIG. 11.
Figure 13:
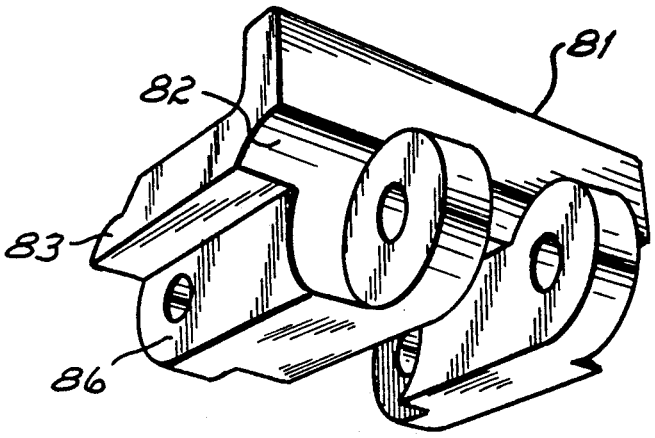
FIGS. 13 and 14 show details of the propulsion chain links used in the propulsion apparatus of FIGS. 11 and 12.
Figure 14:
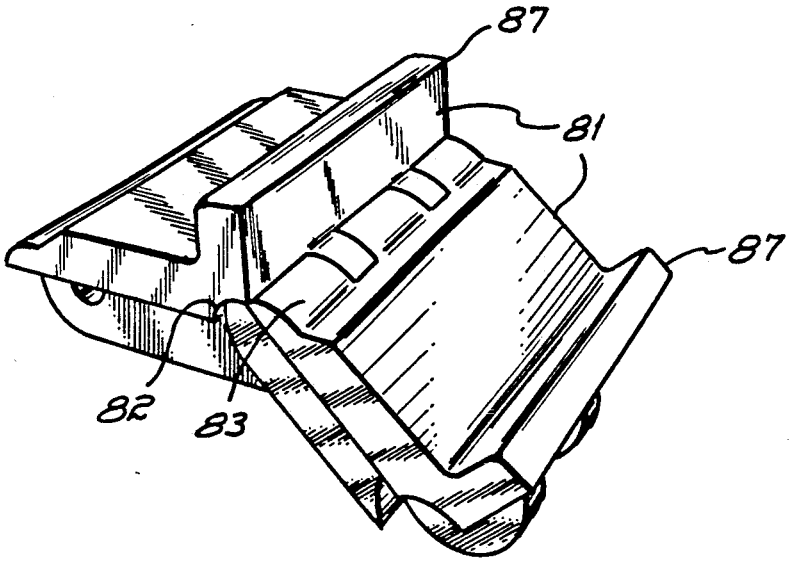

The propulsion apparatus 60 may be operated to propel the trenching arm 63 along a trench by driving the chains 66 and 67 forward (i.e., in a counterclockwise direction of rotation, such that the apparatus of 60 moves to the left as viewed in FIG. 11) at the top at a slow rate comparable to the advance rate of the trenching arm 63. Where it is necessary to excavate a slot at the start of a trench, the chains 66 and 67 may be driven backwards (i.e., counterclockwise as viewed in FIG. 11) at higher speed such that the cleats 87 may scrape material from beneath the chains 66 and 67 and deliver it to the trenching arm 63 for transport to the surface.

Figure 15:
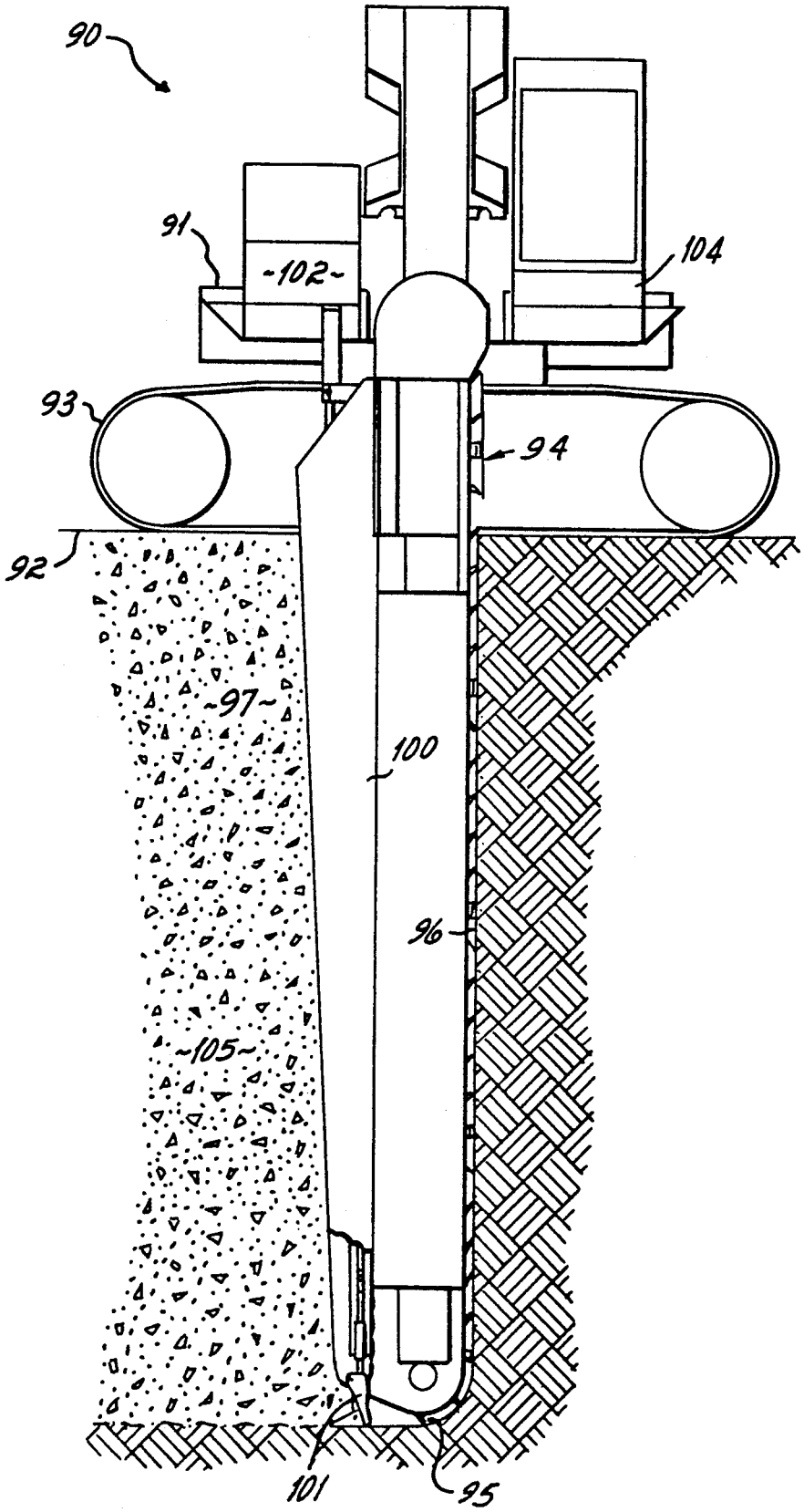
FIG. 15 illustrates an excavator according to the invention.

The excavator apparatus 90 shown in FIG. 15 comprises a tractor 91 which may move along the ground 92 on crawler tracks 93. An endless chain excavator assembly 94 is mounted to the tractor 91 for vertical movement relative to the tractor 91, and carries an endless digging chain 95 which may excavate the advancing face 96 of a trench 97. A U-section concrete form 100 extends vertically along the rear face of the excavator assembly 94, and a combined vertical digger and forward propulsion unit 101 is mounted on the lower end of the concrete form 100. Hydraulic power for the operation of the vertical digger and forward propulsion unit 101 is supplied by a hydraulic power pack 102 mounted on the tractor 91, and operation of the vertical digger and forward propulsion unit 101 is controlled by a solenoid assembly (unnumbered) under the control of a control computer 104. The hydraulic power pack 102 also provides power to drive the crawler tracks 93 and the digging chain 95.

To form an inground wall, the excavator apparatus 90 is positioned above the starting point for the wall with the excavator assembly 94 in a raised position fully above the ground 92. The digging chain 95 is energised, and the vertical digger and forward propulsion unit 101 is operated by the control computer 104 in its vertical digging mode. The excavator assembly is then lowered into the ground, and the digging chain 95 and the vertical digger and forward propulsion unit 101 combine to excavate a starting slot for the trench 97. When the starting slot has reached the desired depth, the crawler tracks 93 are energised for forward motion, and the control computer 104 is switched to control the vertical digger and forward propulsion unit 101 in a forward propulsion mode, urging the digging chain 95 forward against the advancing face 96 of the trench 97.

Concrete is poured into the trench 97 behind the concrete form 100 to form an inground wall 105.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

Attached hereto and incorporated by reference is a Computer Program Appendix listing a computer program for operating the prototype propulsion apparatus of the present invention.

What is claimed is:

1. A method of commencing and continuing a trench, said method comprising the steps of:

providing a tractor operable at ground level;

providing a trenching arm mechanically coupled to said tractor; and operating said trenching arm and a combined digging and propulsion unit at a lower end of said trenching arm, said operating step including the steps of: (a) commencing said trench by digging substantially vertically downwardly from said ground level to establish a base thereof and (b) propelling said trenching arm in a desired, non-downward trenching direction.

2. An apparatus, comprising:

a tractor;

an endless chain excavator mechanically coupled to said tractor;

form means for receiving and forming concrete, said means extending vertically behind said excavator; and digging and propulsion means mounted adjacent a lower end of said form means for selectively digging substantially vertically downwardly from ground level to establish a base of a trench and for propelling said endless chain excavator in a desired non-downward trenching direction along which said trench is to be extended, said form means forming said concrete into a wall within said trench.

3. Apparatus as defined in claim 2, wherein said digging and propulsion means comprises:

an endless-chain digging element carrying teeth; and drive means for driving said endless-chain digging element in a first predetermined direction to dig downwardly to establish said base of said trench and in a second predetermined direction to propel said endless chain excavator in said trenching direction.

4. Trenching apparatus, comprising:

a trenching arm including an upper end, a lower end mutually spaced from said upper end, and combined digging and propulsion means mounted at said lower end for digging a trench substantially vertically downwardly from ground level to establish a base of said trench and for thereafter propelling said lower end in a desired non-downward trenching direction, said digging and propulsion means being mounted adjacent said lower end; and second propulsion means mechanically coupled to said upper end of said trenching arm for propelling said upper end along said trenching direction as said lower end thereof is being propelled therealong by said digging and propulsion means.

5. The apparatus of claim 4 further comprising a concrete receiving and forming member of substantially U-shaped cross section mounted adjacent said trenching arm and extending along at least a portion of the space between said upper and lower ends for forming a wall within said trench as said trench is being extended in said direction by said trenching arm.

6. A trenching method comprising the steps of:

digging substantially vertically downwardly from ground level to a desired trench depth to establish a base for a trench, said digging step comprising the step of operating a trenching arm having mutually spaced upper and lower ends as well as a combined digging and propulsion unit adjacent said lower end to position said trenching arm below ground; and excavating said trench along a desired non-downward trenching direction, said excavating step comprising the steps of propelling said upper end of said trenching arm in said trenching direction with a second propulsion unit located above ground and simultaneously propelling said lower end of said trenching arm in said trenching direction with said combined digging and propulsion unit.

7. The method of claim 6 further comprising the step of:

flowing concrete into a concrete receiving and forming member mounted adjacent said trenching arm, said flowing step being carried out while propelling said trenching arm in said trenching direction so as to form a wall within said trench as it is being excavated in said trenching direction.

* * * * *